US008087370B2

(12) United States Patent
Kitamura et al.

(10) Patent No.: US 8,087,370 B2
(45) Date of Patent: Jan. 3, 2012

(54) SHIP STABILITY RECOVERY SYSTEM AND CAR CARRIER EQUIPPED WITH THE SAME

(75) Inventors: Toru Kitamura, Shimonoseki (JP); Masayoshi Tani, Shimonoseki (JP); Kuniaki Yamato, Shimonoseki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 472 days.

(21) Appl. No.: 12/309,647

(22) PCT Filed: Aug. 12, 2008

(86) PCT No.: PCT/JP2008/064445

§ 371 (c)(1),
(2), (4) Date: Jan. 26, 2009

(87) PCT Pub. No.: WO2010/018618

PCT Pub. Date: Feb. 18, 2010

(65) Prior Publication Data

US 2010/0236464 A1 Sep. 23, 2010

(51) Int. Cl.
*B63B 9/08* (2006.01)

(52) U.S. Cl. ..... 114/121; 114/125

(58) Field of Classification Search ..... 114/121, 114/122, 125

See application file for complete search history.

(56) References Cited

U.S. PATENT DOCUMENTS

| | | | | |
|---|---|---|---|---|
| 4,238,037 | A * | 12/1980 | Azovtsev et al. | 212/277 |
| 5,692,451 | A * | 12/1997 | Pastore | 114/125 |
| 6,769,372 | B2 * | 8/2004 | Sato et al. | 114/65 R |

FOREIGN PATENT DOCUMENTS

| | | |
|---|---|---|
| JP | 54-3797 | 1/1979 |
| JP | 54-96993 | 7/1979 |
| JP | 59-169298 | 11/1984 |
| JP | 1-94094 | 4/1989 |
| JP | 4-23596 | 2/1992 |
| JP | 4-228977 | 8/1992 |
| JP | 4-303096 | 10/1992 |
| JP | 07-304490 | 11/1995 |
| JP | 8-244678 | 9/1996 |
| JP | 9-99893 | 4/1997 |
| JP | 3035843 | 4/1997 |
| JP | 2002-37180 | 2/2002 |
| JP | 2004-009950 | 1/2004 |
| JP | 2005-75051 | 3/2005 |
| JP | 2007-153242 | 6/2007 |
| JP | 2008-30584 | 2/2008 |
| JP | 2008-094345 | 4/2008 |

OTHER PUBLICATIONS

Japanese Official Action dated Jan. 25, 2011 in corresponding Japanese Patent Application No. 2007-040938 w/English translation.

* cited by examiner

*Primary Examiner* — Stephen Avila
(74) *Attorney, Agent, or Firm* — Wenderoth, Lind & Ponack, L.L.P.

(57) ABSTRACT

[Object] Conventionally, measures for securing stability of a ship when it is damaged are required.

[Solution] The invention is characterized by having a remotely openable seawater inlet means provided to a lowermost watertight deck that forms a void space at the bottom of the ship. Thereby, when a side shell plate or the like of the ship is damaged and seawater enters the ship, the seawater that has entered the ship can be introduced into the void space by opening the seawater inlet means provided to the lowermost watertight deck, so that the void space, which usually provides a huge auxiliary buoyancy, can be made to function as a sort of a seawater ballast tank, whereby the ship's stability can be recovered.

12 Claims, 6 Drawing Sheets

SHIP STABILITY RECOVERY SYSTEM AND CAR CARRIER EQUIPPED WITH THE SAME

TECHNICAL FIELD

The present invention relates to a ship stability recovery system for securing a ship's stability when the ship is damaged and a car carrier equipped with the same.

BACKGROUND ART

Measures for securing stability of a ship when it is damaged are required.

For example, a ship such as a passenger boat having a plurality of compartments and provided with a water trap in the hull has been proposed (see, for example, Patent Literature 1), the water trap being structured as a wall element for partitioning adjacent compartments, which is given for the purpose of limiting the amount of flooding water to secure the ship's stability when the ship is damaged; the wall element includes a fire-resistant main wall element that supports a predetermined load, and a fire-resistant additional element that forms a wall partitioning adjacent compartments together with the main wall element and is located under the main wall element, with no liquid filled inside. The additional element blocks movement of a heated gas between the adjacent compartments, while it allows movement of seawater to the other compartment when the seawater enters one of the adjacent compartments.

With the structure described in this Patent Literature 1, when seawater enters one of adjacent compartments due to a hull breach, the water trap causes the seawater to enter the other compartment, too. This brings about a condition in which the plurality of compartments inside the hull are flooded, which suppresses rotational moment around the axis of the hull, whereby the stability performance of the hull is improved.

However, if the above-described water trap is to be applied to a car carrier or the like, there are the following problems: a) There need to be provided a plurality of bulkheads (watertight bulkheads) inside the vehicle stowage compartment, which poses limitations on the compartment design; b) The compartment need to be partitioned by providing watertight sliding doors or the like between vehicle stowage decks; c) Partitioning the vehicle stowage compartment increases the material amount and leads to a cost increase; d) Partitioning the vehicle stowage compartment increases the material amount and leads to an increase in the hull weight (L/W or lift to weight ratio); e) Partitioning the vehicle stowage compartment deteriorates work efficiency during the ship's construction; f) Partitioning the vehicle stowage compartment deteriorates work efficiency of the crew; and g) Limitations will arise on the stowage of vehicles, and the number of vehicles that can be loaded will be decreased.

On the other hand, if no measures are taken, a required value of GoM (transverse metacentric height) will be larger so as to secure the stability of a car carrier or the like when it is damaged. A larger required value of GoM will pose limitations on the stowage of vehicles in the ship service, and such limitations on the vehicle stowage will decrease the scale of operation.

Alternatively, in order to secure the ship's stability when it is damaged, a ballast for lowering the center of gravity would be necessary, which, for a car carrier or the like, will cause a problem that the number of vehicles that can be loaded is decreased.

Another type of ship has also been proposed (see, for example, Patent Literature 2), which includes a flat-bottomed main hull and a submerged tank auxiliary hull that is constituted by adding, under the bottom of the main hull, a submerged tank external hull having an opening for transmitting pressure of incoming and outgoing seawater and an air vent pipe. A joining and securing keel (fin keel) is provided between the lower part of the bottom of the main hull and the interior of the submerged tank auxiliary hull, so that the ship is formed (constituted) by the main hull, which serves as the ship based on conventional ship theories, and the submerged tank auxiliary hull that encompasses a new concept and bears the function of preventing a capsize of the ship. Thereby, the apparent center of gravity is moved to a lower part of the ship so that it is not easily capsized.

However, the one described in Patent Literature 2 is substantially identical to a ship provided with a ballast for lowering the center of gravity, and so it has the problem that the number of vehicles that can be loaded is decreased.

Patent Literature 1: Japanese Published Unexamined Patent Application No. 2004-9950

Patent Literature 2: Japanese Published Unexamined Patent Application No. 7-304490

SUMMARY OF THE INVENTION

Problems to be Solved by the Invention

The present invention was proposed to solve the above problems, its object being to provide a stability recovery system for a ship having a huge auxiliary buoyancy such as a void space (pipe space) or the like near the bottom of the ship, the system being designed to secure the ship's stability when the ship is damaged by effectively utilizing this void space (pipe space) or the like, and a car carrier equipped with this system.

Means for Solving the Problems

The present invention was made to solve the above conventional problems. The invention set forth in respective claims resides in a ship stability recovery system and a car carrier equipped with the same, adopting various means as will be respectively described in the following:

1) The ship stability recovery system according to the first means is characterized by having a remotely openable seawater inlet means provided to a lowermost watertight deck above a void space at a bottom of the ship.

2) The second means is characterized in that, in the ship stability recovery system according to the first means, the seawater inlet means includes a seawater inlet opened in the watertight deck near a side of the ship, a watertight door closing a lower surface of the seawater inlet, and a watertight door opening system for opening the watertight door.

3) The third means is characterized in that, in the ship stability recovery system according to the first means, the seawater inlet means includes a seawater inlet opened in the watertight deck near a side of the ship, a watertight box provided to a lower surface of the watertight deck such as to surround the seawater inlet, a second seawater inlet opened in a side face of the watertight box, a watertight door closing the second seawater inlet, and a watertight door opening system for opening the watertight door.

4) The fourth means is characterized in that, in the ship stability recovery system according to the second or third means, the system further includes a flooding detection system provided on the watertight deck, a flooding indicator indicating that the flooding detection system has detected flooding, and a watertight door operator outputting an operation signal to the watertight door opening system to open the watertight door.

5) The fifth means is characterized in that, in the ship stability recovery system according to the fourth means, the system further includes a stability monitoring and control system in a non-watertight compartment of the ship, and that the flooding indicator and the watertight door operator are provided in the stability monitoring and control system.

6) The sixth means is characterized in that, in the ship stability recovery system according to the fifth means, the stability monitoring and control system includes an automatic-opening-condition input terminal for inputting a condition of the ship, an automatic opening determiner that determines whether or not the watertight door should be automatically opened based on a signal from the flooding detection system indicating that flooding has been detected and based on the condition of the ship input at the automatic-opening-condition input terminal and that outputs an operation signal for opening the watertight door when it has determined to automatically open the watertight door, and a manual/automatic transfer switch that selects either one of an operation signal from the watertight door operator and an operation signal from the automatic opening determiner and that outputs an operation signal to the watertight door opening system to open the watertight door.

7) The seventh means is characterized in that, in the ship stability recovery system according to the fifth or sixth means, the system further includes a water gauge provided in the void space, and that the stability monitoring and control system is provided with a seawater level indicator that receives a signal from the water gauge and indicates a seawater level inside the void space.

8) The eighth means is characterized in that, in the ship stability recovery system according to the first means, the seawater inlet means includes a seawater inlet open/close valve provided in the void space, and a seawater inlet pipe connected to the seawater inlet open/close valve and opened to the watertight deck, and that the system further includes a flooding detection system provided on the watertight deck near the watertight door, a flooding indicator indicating that the flooding detection system has detected flooding, a valve remote control bar for operating the seawater inlet open/close valve, and a valve control handle provided at a distal end of the valve remote control bar.

9) The ninth means is characterized in that, in the ship stability recovery system according to the first means, the seawater inlet means includes a seawater inlet opened in the watertight deck near a side of the ship, a watertight box provided to a lower surface of the lowermost watertight deck such as to surround the seawater inlet, and a second seawater inlet opened in a side face of the watertight box, and that the system further includes a flooding detection system provided on the watertight deck near the watertight door, and a flooding indicator indicating that the flooding detection system has detected flooding.

10) The tenth means is characterized in that, in the ship stability recovery system according to the first means, the seawater inlet means is a longitudinal communication pipe communicating a plurality of air vent pipes provided to the watertight deck on both port and starboard sides of the ship, and that the system further includes a flooding detection system provided on the watertight deck near a side shell plate of the ship, and a flooding indicator indicating that the flooding detection system has detected flooding.

11) The eleventh means is characterized in that, in the ship stability recovery system according to any one of the eight to tenth means, the system further includes a water gauge provided in the void space, and a seawater level indicator that receives a signal from the water gauge and indicates a seawater level inside the void space.

12) A car carrier according to the twelfth means is characterized by having the ship stability recovery system according to any one of the first to eleventh means.

Effects of the Invention

With the above-described various means being adopted, the ship stability recovery system and the car carrier equipped with the same as set forth in respective claims of the invention provide the following effects:

According to the invention as set forth in various claims of the present application, in the event that a side shell plate or the like of the ship is damaged and seawater enters the ship, the seawater inlet means provided in the lowermost watertight deck is opened, so that the seawater that has entered the ship is introduced into the void space (pipe space) and thereby the void space (pipe space), which usually provides a huge auxiliary buoyancy, can be made to function as a sort of a seawater ballast tank, whereby the ship's stability can be recovered.

DESCRIPTION OF THE REFERENCE NUMERALS

Figure 1:
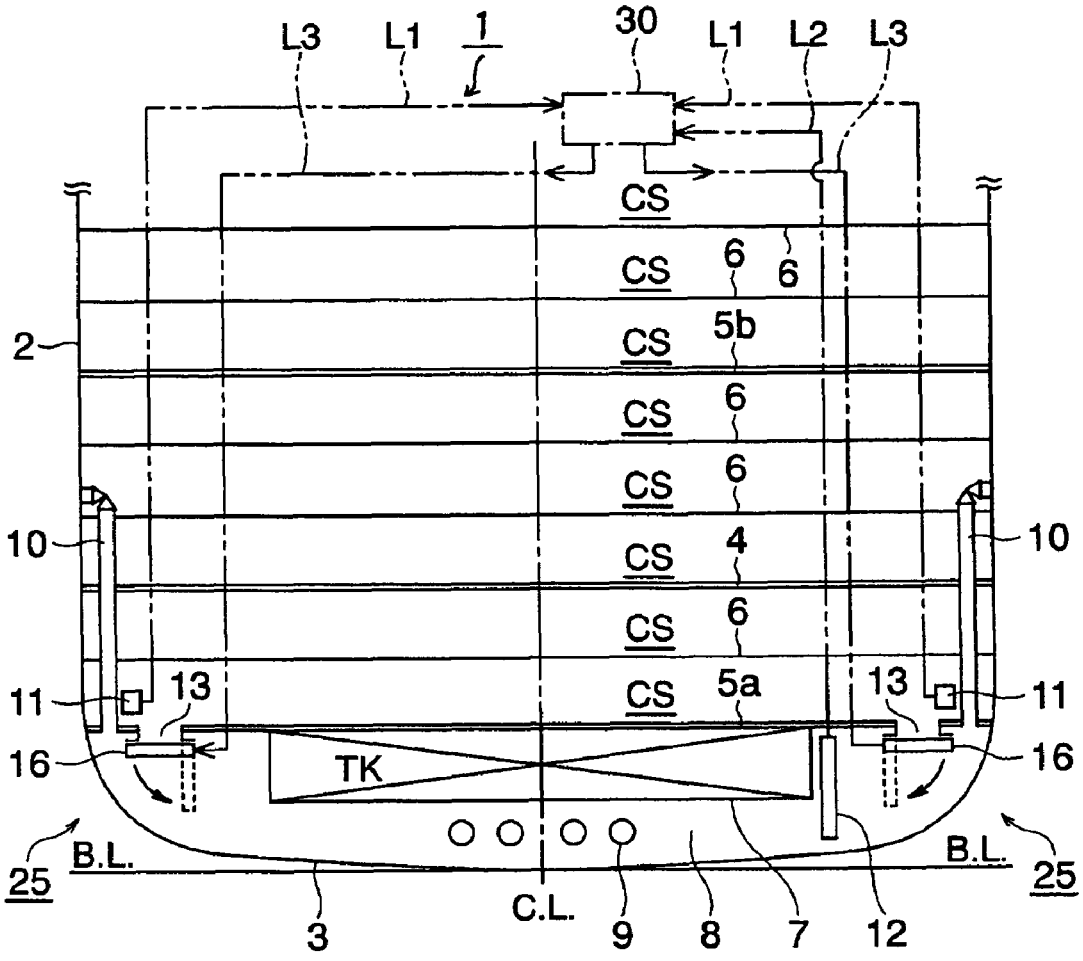
FIG. 1 is a front cross-sectional view of a car carrier equipped with a ship stability recovery system according to a first embodiment of the present invention.

1 car carrier
2 side shell plate
3 bottom shell plate
4 freeboard deck
5*a*, 5*b* watertight deck
6 vehicle stowage non-watertight deck
7 ballast tank
8, 8*a* void space
9 pipe
10 air vent pipe
11 flooding detection system
12 water gauge
13 seawater inlet
14 watertight box
15 second seawater inlet
16 watertight door
17 seawater inlet pipe
18 seawater inlet open/close valve
19 valve remote control bar
20 valve control handle
21 longitudinal communication pipe
22 stopper
23 hydraulic cylinder unit
24 watertight door opening system
25 seawater inlet means
30 stability monitoring and control system
31 flooding indicator
32 automatic opening determiner
33 manual/automatic transfer switch
34 manual watertight door operator
35 seawater level indicator
36 automatic-opening-condition input terminal
L1 detection signal line
L2 seawater level detection signal line
L3 valve control signal line
L4 opening condition signal line
CS vehicle stowage compartment

DETAILED DESCRIPTION OF THE INVENTION

Various embodiments of the present invention will be hereinafter described with reference to FIG. 1 to FIG. 6.

Figure 2:
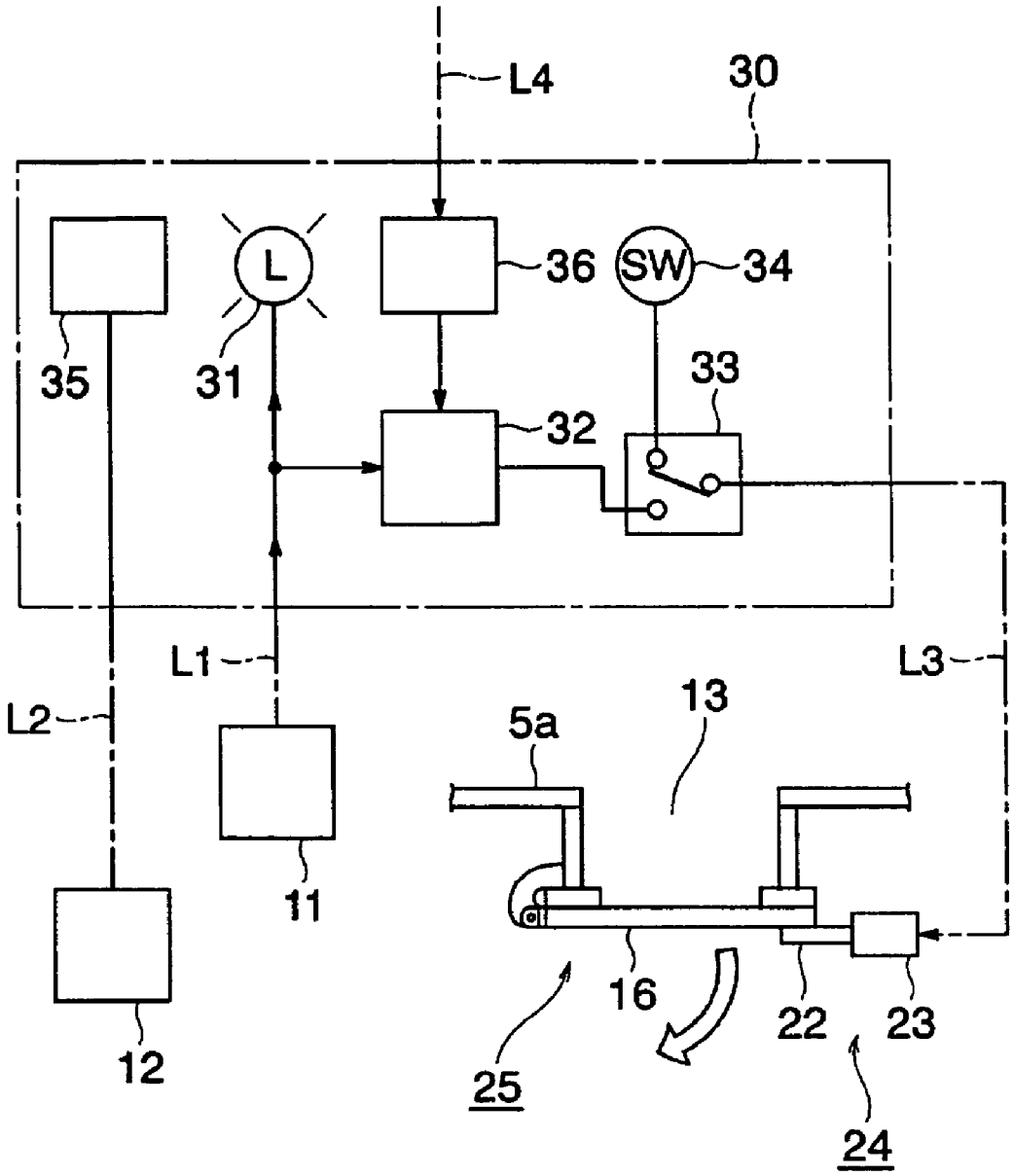
FIG. 2 is a circuit diagram of a stability monitoring and control system of the same.
Figure 3:
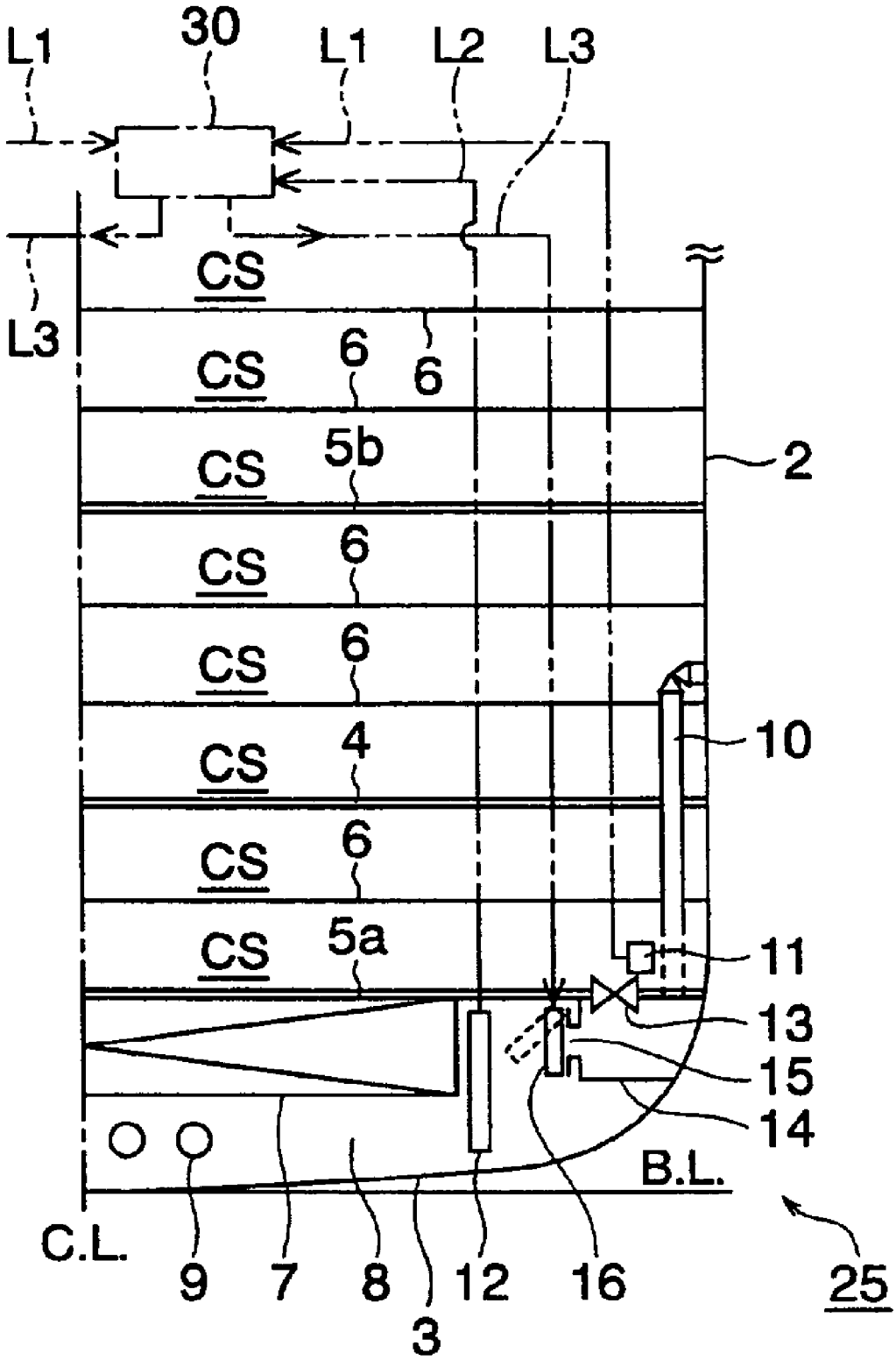
FIG. 3 is a front cross-sectional view of a car carrier equipped with a ship stability recovery system according to a second embodiment of the present invention.
Figure 4:
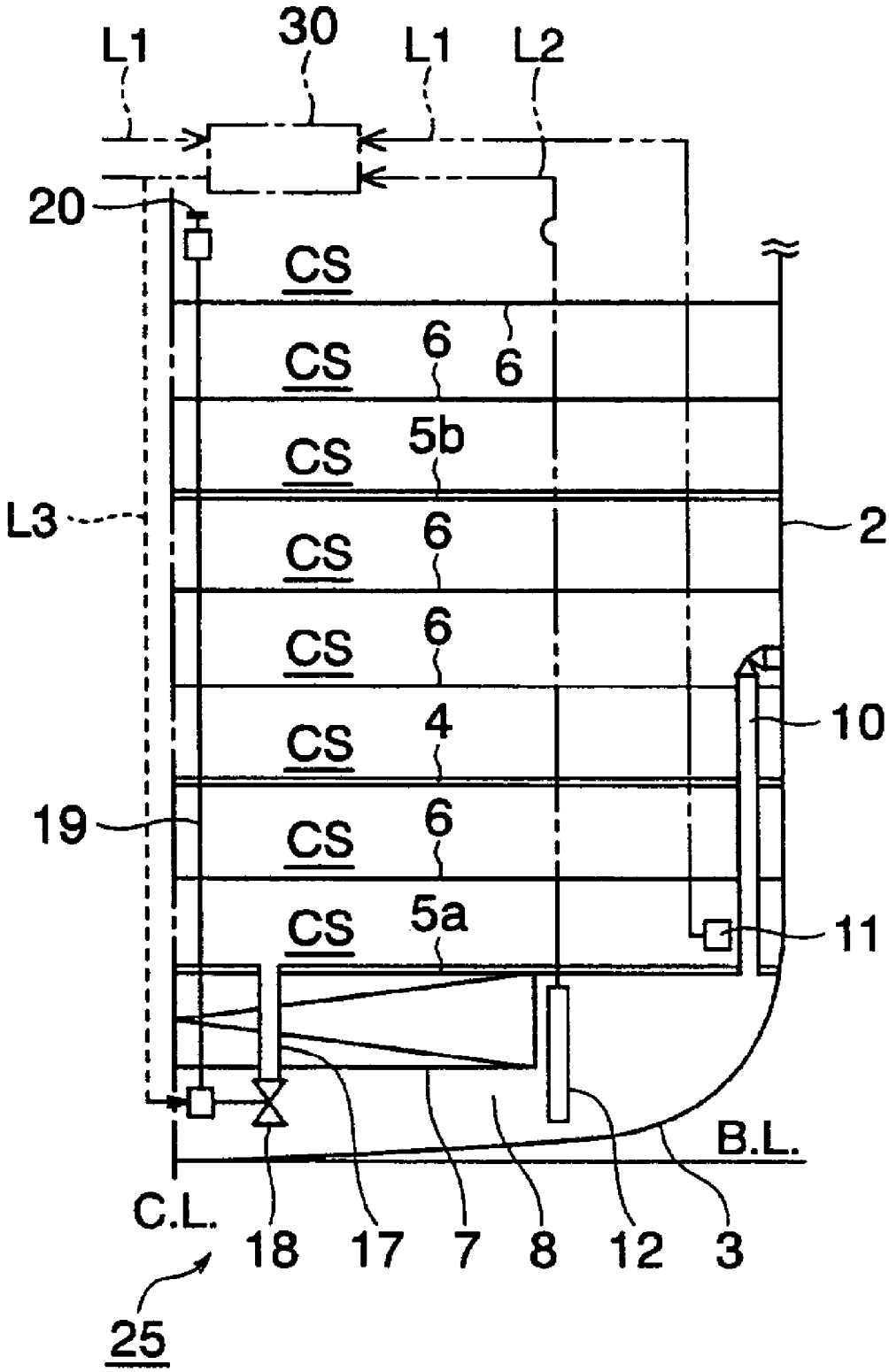
FIG. 4 is a front cross-sectional view of a car carrier equipped with a ship stability recovery system according to a third embodiment of the present invention.
Figure 5:
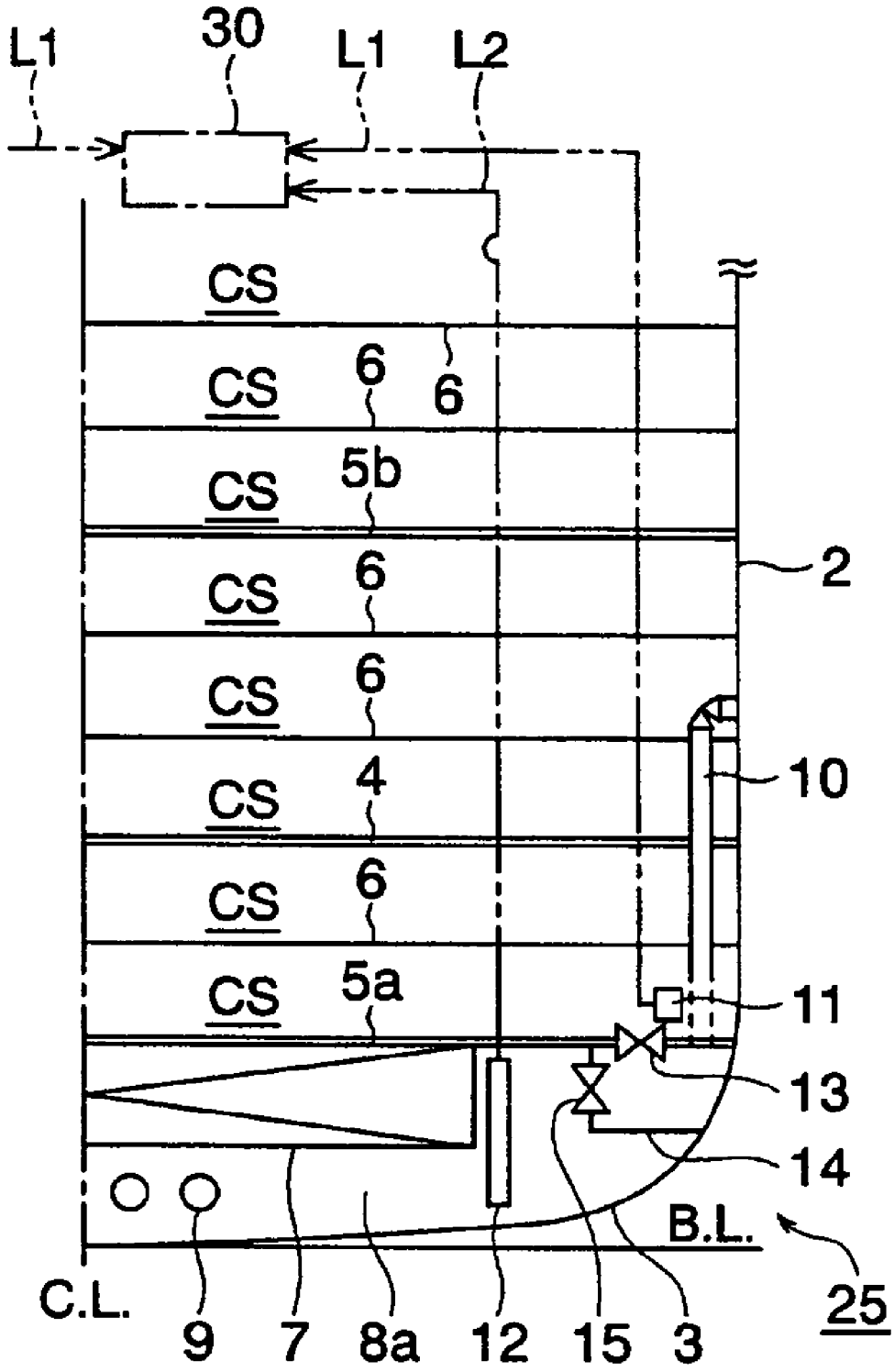
FIG. 5 is a front cross-sectional view of a car carrier equipped with a ship stability recovery system according to a fourth embodiment of the present invention.
Figure 6:
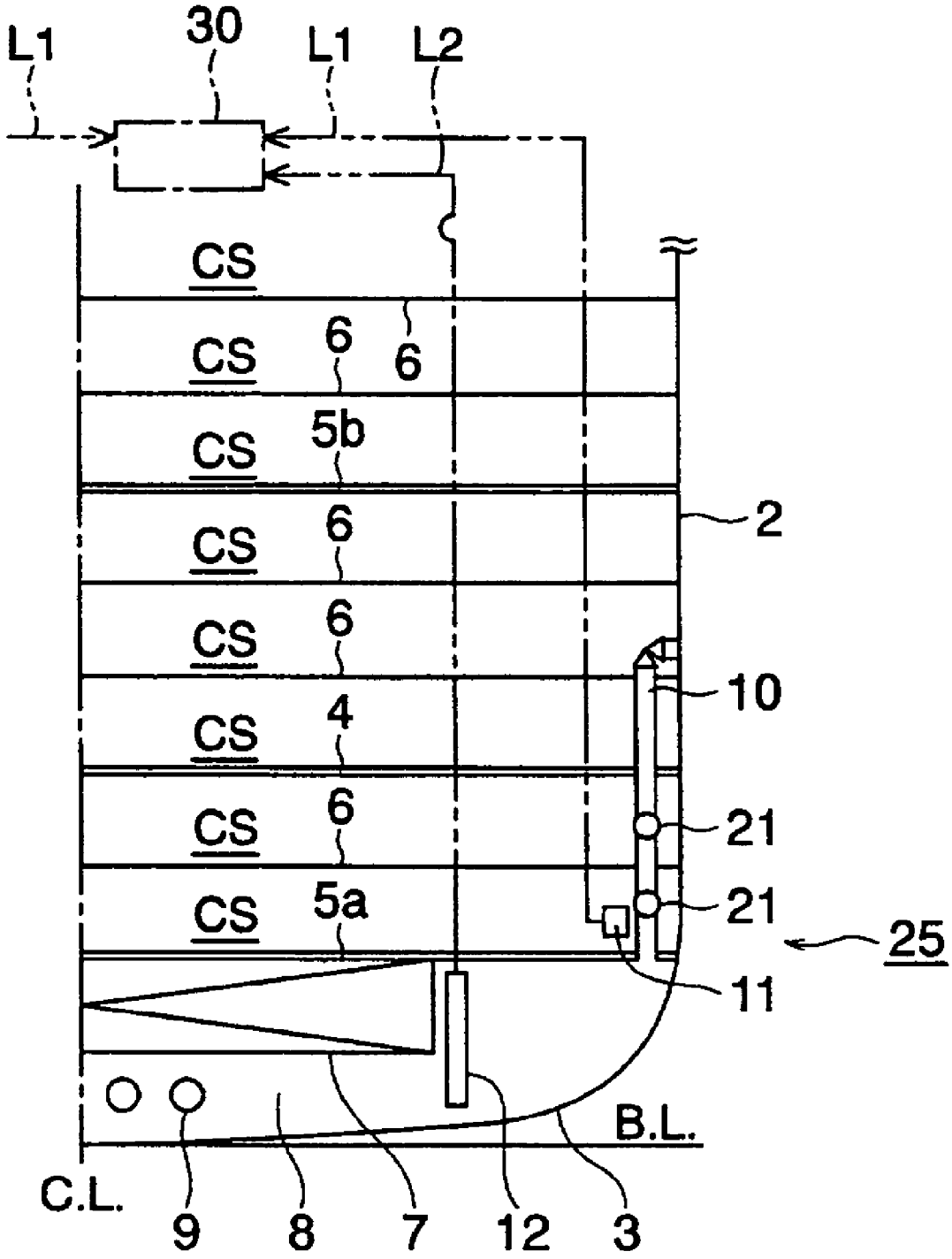
FIG. 6 is a front cross-sectional view of a car carrier equipped with a ship stability recovery system according to a fifth embodiment of the present invention.

FIG. 1 is a front cross-sectional view of a car carrier equipped with a ship stability recovery system according to a first embodiment of the present invention, and FIG. 2 is a circuit diagram of a stability monitoring and control system of the same. FIG. 3 is a front cross-sectional view of a car carrier equipped with a ship stability recovery system according to a second embodiment of the present invention, FIG. 4 is a front cross-sectional view of a car carrier equipped with a ship stability recovery system according to a third embodiment of the present invention, FIG. 5 is a front cross-sectional view of a car carrier equipped with a ship stability recovery system according to a fourth embodiment of the present invention, and FIG. 6 is a front cross-sectional view of a car carrier equipped with a ship stability recovery system according to a fifth embodiment of the present invention.

First, the structure of the car carrier equipped with the ship stability recovery system according to the first embodiment of the present invention will be described with reference to FIG. 1 and FIG. 2.

As shown in FIG. 1, the car carrier 1 is formed to have a generally box-like cross-sectional shape with side shell plates 2 and a bottom shell plate 3.

Inside this car carrier 1, a freeboard deck 4 (deck for transferring vehicles to and from the ship, watertight deck), plural layers of watertight decks 5*a* and 5*b* for vehicle stowage and multiple layers of non-watertight decks 6 for vehicle stowage.

Namely, the watertight freeboard deck 4 is provided near the center in the up and down direction of the car carrier 1.

An outboard ramp (not shown) is coupled to this freeboard deck 4 for vehicle roll-on/roll-off.

The watertight deck 5*a* for vehicle stowage is provided in a lowermost part of the car carrier 1, and the watertight deck 5*b* for vehicle stowage is also provided above the freeboard deck 4.

Further, between the freeboard deck 4 and the upper vehicle-stowage watertight deck 5*b*, and between the freeboard deck 4 and the lowermost vehicle-stowage watertight deck 5*a*, at least one layer or more of non-watertight deck(s) 6 for vehicle stowage are provided.

Plural layers (5 to 7 layers) of vehicle-stowage non-watertight decks 6 are provided above the upper watertight deck 5*b*, too.

Multiple layers (e.g. 10 to 12 layers) of vehicle stowage compartments CS are formed between the freeboard deck 4, plural layers of watertight decks 5*a* and 5*b*, and multiple layers of non-watertight decks 6.

Meanwhile, a ballast tank 7 (or fuel tank or the like) is provided below the lowermost vehicle-stowage watertight deck 5*a*.

In the case with a fuel tank, the tank is provided a certain distance above the bottom shell plate 3, as it needs to have a double shell design to prevent a fuel spill when the ship bottom is damaged.

A void space 8 (pipe space) is formed between the bottom shell plate 3 and the lowermost watertight deck 5*a* or a tank bottom plate of the ballast tank 7 (or the fuel tank or the like), and a large number of pipes 9 are laid out in this void space 8 for pumping ballast water or fuel or the like.

This void space 8 (or pipe space) is not used as a (fixed or seawater) ballast or the like, and provides a huge auxiliary buoyancy.

The ship stability recovery system and the car carrier equipped with the same of this embodiment are designed to enable a ship which, while having the huge auxiliary buoyancy of the void space 8, cannot effectively utilize this auxiliary buoyancy, to recover its remaining stability.

The invention takes into account that many conventional ships, while they satisfy required specifications in a full load condition, do not satisfy required specifications particularly in a ballast loaded condition because of a lack of remaining stability.

Namely, it is considered that conventional ships suffer a lack of stability (GZ) resulting from the effect of transverse heeling or the like after flooding of the ship in a ballast loaded condition or the like. With the ship stability recovery system and the car carrier equipped with the same of this embodiment, the transverse metacentric height is increased by correction of transverse heeling and lowering of the center of gravity.

According to conventional methods, it is common to secure remaining stability when the ship is damaged by reducing the volume of a flooded compartment. On the other hand, according to the ship stability recovery system and the car carrier equipped with the same of this embodiment, in view of the fact that required specifications can be met in a full load condition, the flooded volume is increased to deepen the draft after the flooding and to secure stability (GZ), by effectively using the huge auxiliary buoyancy to secure remaining stability.

Accordingly, in the ship stability recovery system or the car carrier equipped with the same of a first embodiment of the present invention, in addition to the structure described above, a watertight door 16 (including various forms such as a watertight hatch) is provided to a seawater inlet 13 opened in the lowermost vehicle-stowage watertight deck 5*a* respectively near the left and right side shell plates 2.

The watertight door 16 is coupled at one end to a flange or the like of the seawater inlet 13 with a hinge pin or the like, the other end thereof being closed with a stopper 22 (including various forms such as a key) as shown in FIG. 2.

To this stopper 22 is coupled a hydraulic cylinder unit 23.

Driving a watertight door opening system 24 constituted by the stopper 22 and the hydraulic cylinder unit 23 frees the stopper 22 from the watertight door 16, allowing the watertight door 16 to open.

Note, the watertight door opening system 24 should not be limited to the one constituted by the stopper 22 and the hydraulic cylinder unit 23, and it may be an open/close hydraulic cylinder that opens as well as closes the watertight door 16.

Although not shown, the hydraulic cylinder unit 23 may include, not only a hydraulic cylinder, but also various types of valves that control the flow of operating oil and electromagnetic coils or the like for driving the valves.

A seawater inlet means 25 remotely operable to open is constituted by the seawater inlet 13, flange, watertight door 16, stopper 22, and hydraulic cylinder unit 23 or the like.

Admittedly, there existed some conventional car carriers 1 or the like that are provided with a hatch or the like in a lowermost vehicle-stowage watertight deck 5*a*.

However, conventional hatches were closed using multiple bolts and nuts or the like, and in order to open up the hatch, it was necessary to approach the hatch to remove the multiple nuts.

In contrast, the seawater inlet means 25 provided in the lowermost vehicle-stowage watertight deck 5*a* in this embodiment can be opened by remote control.

Thus, unlike conventional hatches or the like, the seawater inlet means 25 can be readily opened by remote control even if the place where the means is located is flooded with seawater.

Furthermore, in a lowermost vehicle stowage compartment CS on the vehicle-stowage watertight deck 5*a*, a flooding detection system 11 such as a flooding detector, TV camera or a level switch and the like is provided. It is desirable to provide a plurality of the flooding detection systems 11 along the fore-and-aft direction (e.g. at least at three locations including the vicinity of the bow, center, and the vicinity of the stern) respectively near the port and starboard side shell plates 2.

The flooding detection system 11 may include, for example, an electric wire or optical fiber and the like attached to an inner surface of the side shell plates 2 so as to detect flooding by sensing that the electric wire or optical fiber has been cut off due to a hull breach.

A water gauge 12 is provided in the void space 8 for detecting the water level of seawater that has flowed in.

Conventional ships are built based on the assumption that no seawater is introduced into the void space 8, and therefore there was usually only a simple level switch (e.g. a float switch for turning on and off a bilge pump) or the like near an upper surface of the bottom shell plate 3.

The ship of this embodiment is provided with the water gauge 12 in the void space 8, because its design presupposes introduction of seawater into the void space 8.

This water gauge 12 may be constituted, for example, by level switches (float switches) provided at least at three locations including a lower part, an upper part, and a central part of the void space 8.

Note, a sounding pipe may be adopted instead of the water gauge 12.

Meanwhile, in a non-watertight compartment above the ship's freeboard deck 4 of the car carrier 1, for example, in a wheel house or a cargo control room or the like, a stability monitoring and control system 30 is provided.

The stability monitoring and control system 30 and the watertight door opening system 24 for driving the watertight door 16 are connected via a valve control signal line L3.

The stability monitoring and control system 30 and the flooding detection system 11 are connected via a detection signal line L1.

The stability monitoring and control system 30 and the water gauge 12 are connected via a seawater level detection signal line L2.

The stability monitoring and control system 30 is provided with a flooding indicator 31 (flooding indicator lamp or a TV picture), a manual/automatic transfer switch 33 (transfer switch), a manual watertight door operator 34 (press button or switch), and a seawater level indicator 35 for indicating the level of seawater in the void space 8 that is input through the seawater level detection signal line L2.

The stability monitoring and control system 30 further includes an automatic opening determiner 32 and an automatic-opening-condition input terminal 36.

Ship conditions (conditions used for automatic opening determination) to be input to this automatic-opening-condition input terminal 36 include, for example, a signal indicating a ballast loaded condition of the car carrier 1, a signal from a draft gauge indicating that the draft of the car carrier 1 measured by an existing draft gauge is below a predetermined level (ballast loaded condition), a signal from a clinometer indicating that the car carrier 1 is inclined at an angle more than an allowable level, a signal from a shock accelerometer indicating that the car carrier 1 was subjected to a large shock, or a signal from a wind gauge indicating a strong wind, and the like.

These automatic opening determination conditions are input through an opening condition signal line L4.

The signals input from the automatic-opening-condition input terminal 36 are transmitted to the automatic opening determiner 32.

The automatic opening determiner 32 receives a signal from the flooding detection system 11 indicating a flooding condition sent through the detection signal line L1 and a signal indicating a ship's condition (automatic opening determination condition) from the automatic-opening-condition input terminal 36, and determines whether or not automatic opening should be effected based on these signals.

For example, when flooding is detected as well as the ship is inclined abnormally, or, when all the conditions, i.e., flooding detected, shallow draft (ballast loaded condition), abnormal inclination, large impact, strong wind, are met, it is determined that automatic opening is necessary.

When the automatic opening determiner 32 determines that automatic opening is necessary, an operation signal for opening the watertight door 16 is output to the manual/automatic transfer switch 33.

When switched to the manual mode, the manual/automatic transfer switch 33 selects the signal from the manual watertight door operator 34 and transmits the signal to the watertight door opening system 24 via the valve control signal line L3, and when switched to the automatic mode, it selects the signal from the automatic opening determiner 32 and transmits the signal via the valve control signal line L3.

Various operators and arithmetic processing units in the stability monitoring and control system 30 should not be limited to those configured by individual electric circuits, but may include, for example, those in the form of a subprogram or subsequence or the like in a ship-handling control and monitoring panel or the like having a computer for integrally controlling and monitoring the operation of the car carrier 1.

The ship stability recovery system or the car carrier equipped with the same according to the first embodiment of the present invention is configured as described above; when the side shell plate 2 or the like of the car carrier 1 is damaged and seawater enters the lowermost vehicle stowage compartment CS, this condition is detected by the flooding detection system 11, and the detection signal is transmitted to the stability monitoring and control system 30 via the detection signal line L1.

In the stability monitoring and control system 30, this information is indicated by the flooding indicator 31 (flooding indicator lamp, or TV picture).

In the stability monitoring and control system 30, when the manual/automatic transfer switch 33 has been switched to the "manual" mode, an operator, having recognized from the flooding indicator 31 that seawater has entered the lowermost vehicle stowage compartment CS, operates the manual watertight door operator 34.

Then this operation signal is transmitted to the hydraulic cylinder unit 23 of the watertight door opening system 24 via the valve control signal line L3, whereupon the hydraulic cylinder unit 23 drives the stopper 22 to release it from the watertight door 16, allowing the watertight door 16 to open.

If the manual/automatic transfer switch 33 in the stability monitoring and control system 30 has been switched to the "automatic" mode, when a flooding detection signal is received from the flooding detection system 11 through the detection signal line L1, this information is indicated by the flooding indicator 31 (flooding indicator lamp or TV picture), as well as transmitted to the automatic opening determiner 32.

If the automatic opening determiner 32 has already received an automatic opening condition signal from the automatic-opening-condition input terminal 36, then it determines that seawater has entered the lowermost vehicle stowage compartment CS. Then the automatic opening determiner 32 immediately transmits an operation signal to the hydraulic cylinder unit 23 of the watertight door opening system 24 through the valve control signal line L3 to drive the hydraulic cylinder unit 23.

In the watertight door opening system 24, the hydraulic cylinder unit 23 causes the stopper 22 to be released from the watertight door 16 so that the watertight door 16 is opened.

Thus the seawater inlet means 25 is operated to open by remote control.

When the watertight door 16 is opened, the seawater that has entered the lowermost vehicle stowage compartment CS enters the void space 8 through the open watertight door 16.

The condition (water level) of the seawater that has entered the void space 8 is detected by the water gauges 12, and the detection signal is indicated by the seawater level indicator 35 in the stability monitoring and control system 30 through the seawater level detection signal line L2.

This way, in the event that the side shell plate 2 or the like of the car carrier 1 is damaged and seawater enters the ship, the seawater inlet means 25 provided in the lowermost watertight deck 5*a* is opened so that the seawater that has entered the ship can be introduced into the void space 8. Accordingly, the void space 8, which usually provides a huge auxiliary buoyancy, can be made to function as a sort of a seawater ballast tank, whereby the stability of the car carrier 1 can be recovered.

The seawater that has accumulated in the void space 8 is pumped out of the ship by a common bilge pump (not shown) or the like.

Second Embodiment

Next, a car carrier equipped with a ship stability recovery system according to a second embodiment of the present invention will be described with reference to FIG. 3 (and FIG. 2).

Unlike the one according to the first embodiment of the present invention shown in FIG. 1 in which the watertight doors 16 are directly provided to the watertight deck 5*a*, the one according to the second embodiment of the present invention includes a seawater inlet 13 opened in the watertight deck 5*a* respectively on both port and starboard sides, a watertight box 14 provided to a lower surface of the watertight deck 5*a* such as to respectively surround each seawater inlet 13, and a second seawater inlet 15 opened in a side face of each watertight box 14. The watertight door 16 is provided to each of these second seawater inlets 15.

Each of the watertight doors 16 is provided in the vertical direction, with the top end coupled to the side face of the watertight box 14 by a hinge pin or the like, similarly to the one shown in FIG. 2.

The watertight door 16 is arranged such that it can be opened by operating the stopper 22 and the hydraulic cylinder unit 23.

Each seawater inlet means 25 remotely operable to open is constituted by the seawater inlet 13, watertight box 14, flange, second seawater inlet 15, watertight door 16, and stopper 22 and hydraulic cylinder unit 23 or the like shown in FIG. 2.

Each of the seawater inlets 13 in the watertight deck 5*a* on both port and starboard sides is provided with grating or the like to prevent a solid object from falling into the void space 8.

Note, air vent pipes 10 are arranged such as not to overlap with the watertight boxes 14.

Other components, such as the flooding detection systems 11, water gauges 12, stability monitoring and control system 30, flooding indicator 31, automatic opening determiner 32, manual/automatic transfer switch 33, manual watertight door operator 34, seawater level indicator 35, automatic-opening-condition input terminal 36, and others, are provided similarly to the one according to the first embodiment of the present invention shown in FIG. 1 and FIG. 2.

According to the car carrier equipped with the ship stability recovery system of the second embodiment of the present invention, the same effects as those of the first embodiment of the invention are achieved, and in addition, since the watertight door 16 is connected by a hinge pin or the like and provided in the vertical direction, when seawater flows in, the watertight door 16 opens by the force of incoming seawater but is closed relative to outgoing seawater, i.e., it functions as a check valve, so that the seawater that has flowed into the ballast tank 7 does not leak outside again.

Third Embodiment

Next, a car carrier equipped with a ship stability recovery system according to a third embodiment of the present invention will be described with reference to FIG. 4.

Instead of the watertight door 16 or the like of the one according to the first embodiment of the present invention shown in FIG. 1, the one according to the third embodiment of the present invention is provided with a seawater inlet open/close valve 18.

Namely, a seawater inlet pipe 17 is connected to the vehicle-stowage watertight deck 5*a* near the center of the hull, and the seawater inlet open/close valve 18 is connected to the distal end of the seawater inlet pipe 17.

The seawater inlet open/close valve 18 is arranged to be opened and closed by a valve remote control bar 19 extending to above the freeboard deck 4 and a valve control handle 20 provided at the top end of the valve remote control bar 19.

The seawater inlet means 25 remotely operable to open is constituted by the seawater inlet pipe 17, seawater inlet open/close valve 18, and others.

Other components, such as the flooding detection systems 11, water gauges 12, stability monitoring and control system 30, flooding indicator 31, seawater level indicator 35, and others, are provided similarly to the one according to the first embodiment of the present invention shown in FIG. 1 and FIG. 2.

A remotely controllable seawater inlet open/close valve 18 may be employed in place of the above-described seawater inlet open/close valve 18, valve remote control bar 19, and valve control handle 20.

In this case, as indicated by a dotted line in FIG. 4, the valve control signal line L3 for the remote control is connected to the seawater inlet open/close valve 18.

In this case, the stability monitoring and control system 30 also includes, as shown in FIG. 2, the automatic opening determiner 32, manual/automatic transfer switch 33, manual watertight door operator 34, and automatic-opening-condition input terminal 36.

According to the car carrier equipped with the ship stability recovery system of the third embodiment of the present invention, the same effects as those of the first embodiment of the invention are achieved.

Fourth Embodiment

Next, a car carrier equipped with a ship stability recovery system according to a fourth embodiment of the present invention will be described with reference to FIG. 5.

As compared to the one according to the second embodiment of the present invention shown in FIG. 3, the one according to the fourth embodiment of the invention does not include the watertight doors 16.

Namely, the side face of each watertight box 14 has only the second seawater inlet 15 respectively opened therein. In this case, the void space 8*a* is considered to be a vehicle stowage compartment, and therefore it must be provided with appropriate equipment (fire detector, sprinkler, lighting, etc.) similar to that of the vehicle stowage compartments CS.

The air vent pipes 10 may be communicated to the watertight boxes 14, or alternatively, they may be arranged so as not to overlap with the watertight boxes.

Each seawater inlet means 25 remotely operable to open is constituted by the seawater inlet 13, watertight box 14, flange, second seawater inlet 15, and others.

Other components, such as the flooding detection systems 11, water gauges 12, stability monitoring and control system 30, flooding indicator 31, seawater level indicator 35, and others, are provided similarly to the one according to the first embodiment of the present invention shown in FIG. 1 and FIG. 2.

According to the car carrier equipped with the ship stability recovery system of the fourth embodiment of the present invention, the same effects as those of the first embodiment of the invention are achieved, and further there is an advantage that the system is more simple because it has no movable parts.

Fifth Embodiment

Next, a car carrier equipped with a ship stability recovery system according to a fifth embodiment of the present invention will be described with reference to FIG. 6.

The one according to the fifth embodiment of the present invention utilizes the plurality of air vent pipes 10 provided along the side shell plates 2 of the car carrier 1, and is provided with longitudinal communication pipes 21 that extend along the side shell plates 2 in the for-and-aft direction and that communicate the plurality of air vent pipes 10.

One each of this longitudinal communication pipe 21 is provided in an upper vehicle stowage compartment CS and in a lower vehicle stowage compartment CS of the watertight deck 5*a* below the freeboard deck 4 on both port and starboard sides of the ship (a total of four pipes).

Each seawater inlet means 25 remotely operable to open is constituted by the air vent pipes 10, longitudinal communication pipes 21, and others.

With the above-described structure, when the side shell plate 2 of the car carrier 1 is damaged, these longitudinal communication pipes 21 are broken and ruptured at the same time.

This allows seawater to enter from the broken part and to flow into the void space 8 through the longitudinal communication pipes 21 and the air vent pipes 10.

Other components, such as the flooding detection systems 11, water gauges 12, stability monitoring and control system 30, flooding indicator 31, seawater level indicator 35, and others, are provided similarly to the one according to the first embodiment of the present invention shown in FIG. 1 and FIG. 2.

According to the car carrier equipped with the ship stability recovery system of the fifth embodiment of the present invention, the same effects as those of the first embodiment of the invention are achieved, and further there is an advantage that the system is more simple because it has no movable parts.

Moreover, since the void space 8 is not a vehicle stowage compartment, it need not be provided with the equipment (fire detector, sprinkler, lighting, etc.) similar to that of the vehicle stowage compartments CS as with the one according to the fourth embodiment of the present invention.

While various embodiments of the present invention have been described above, it should be understood that the invention is not limited to the above-described embodiments and various modifications may be made to the specific structures of the embodiments within the scope of the present invention.

The invention claimed is:

1. A stability recovery system for a ship, comprising:

a remotely openable seawater inlet means provided to a lowermost watertight deck above a void space at a bottom of the ship, wherein the seawater inlet means includes a seawater inlet opened in the watertight deck near a side of the ship, a watertight door closing a lower surface of the seawater inlet, and a watertight door opening system for opening the watertight door;

a flooding detection system which is provided on the watertight deck;

a flooding indicator which indicates that the flooding detection system has detected flooding; and a watertight door operator that transmits an operation signal to the watertight door opening system so as to open the watertight door.

2. A stability recovery system for a ship, comprising:

a remotely openable seawater inlet means provided to a lowermost watertight deck above a void space at a bottom of the ship, wherein the seawater inlet means includes a first seawater inlet opened in the watertight deck near a side of the ship, a watertight box provided to a lower surface of the watertight deck so as to surround the first seawater inlet, a second seawater inlet opened in a side face of the watertight box, a watertight door closing the second seawater inlet, and a watertight door opening system for opening the watertight door;

a flooding detection system which is provided on the watertight deck;

a flooding indicator which indicates that the flooding detection system has detected flooding; and a watertight door operator that transmits an operation signal to the watertight door opening system so as to open the watertight door.

3. The stability recovery system for a ship according to claim 1, further comprising:

a stability monitoring and control system in a non-watertight compartment of the ship, wherein the flooding indicator and the watertight door operator are provided in the stability monitoring and control system.

4. The stability recovery system for a ship according to claim 3, wherein the stability monitoring and control system includes an automatic-opening-condition input terminal for inputting a condition of the ship, an automatic opening determiner that determines whether or not the watertight door should be automatically opened based on a signal from the flooding detection system indicating that flooding has been detected and based on the condition of the ship input at the automatic-opening-condition input terminal and that outputs an operation signal for opening the watertight door when it has determined to automatically open the watertight door, and a manual/automatic transfer switch that selects either one of an operation signal from the watertight door operator and an operation signal from the automatic opening determiner and that outputs an operation signal to the watertight door opening system to open the watertight door.

5. The stability recovery system for a ship according to claim 3, further comprising:

a water gauge provided in the void space, wherein the stability monitoring and control system is provided with a seawater level indicator that receives a signal from the water gauge and indicates a seawater level inside the void space.

6. A stability recovery system for a ship, comprising:

a remotely openable seawater inlet means provided to a lowermost watertight deck above a void space at a bottom of the ship, wherein the seawater inlet means includes a first seawater inlet opened in the watertight deck near a side of the ship, a watertight box provided to a lower surface of the lowermost watertight deck so as to surround the first seawater inlet, a second seawater inlet opened in a side face of the watertight box, and a watertight door closing the second seawater inlet;

a flooding detection system provided on the watertight deck near the watertight door; and a flooding indicator indicating that the flooding detection system has detected flooding.

7. The stability recovery system for a ship according to claim 6, further comprising:

a water gauge provided in the void space; and a seawater level indicator that receives a signal from the water gauge and indicates a seawater level inside the void space.

8. A car carrier comprising the stability recovery system for a ship according to claim 1.

9. A stability recovery system for a ship, comprising:

seawater inlet means including air vent pipes disposed vertically along a starboard side and a port side of the ship so as to communicate with a lowermost watertight deck, the lowermost watertight deck being arranged above a void space at a bottom of the ship, wherein the ship includes a plurality of watertight decks, wherein bottom ends of the air vent pipes are connected to the lowermost watertight deck, and top ends of the air vent pipes are extended through the plurality of watertight decks, and wherein the air vent pipes are arranged so as to allow seawater to be introduced into the void space through the air vent pipes in response to a shell plate of the ship being damaged.

10. The stability recovery system for a ship according to claim 9, wherein the seawater inlet means further includes longitudinal communication pipes which communicate with the air vent pipes.

11. The stability recovery system for a ship according to claim 10, wherein the longitudinal communication pipes are disposed in a fore-and-aft direction along shell plates of the ship at the starboard side and the port side, and wherein the longitudinal communication pipes are arranged so as to allow seawater to be introduced into the void space through the air vent pipes via the longitudinal communication pipes in response to a shell plate of the ship being damaged.

12. The stability recovery system for a ship according to claim 10, wherein the ship includes a non-watertight deck above the lowermost watertight deck, and wherein the longitudinal communication pipes are disposed above and below the non-watertight deck.

* * * * *